US006088849A

United States Patent [19]

Lieber

[11] Patent Number: 6,088,849

[45] Date of Patent: Jul. 18, 2000

[54] PIECE OF FURNITURE

[76] Inventor: Bert Lieber, Im Heidewinkel 12, D-70839 Gerlingen, Germany

[21] Appl. No.: 09/114,033

[22] Filed: Jul. 10, 1998

[30] Foreign Application Priority Data

Jul. 10, 1997 [DE] Germany ..... 197 29 462

[51] Int. Cl.[7] ..... A47B 83/00

[52] U.S. Cl. ..... 5/2.1; 5/159.1; 312/315

[58] Field of Search ..... 5/2.1, 159.1, 136; 312/290, 315, 327, 329

[56] References Cited

U.S. PATENT DOCUMENTS

| | | | |
|---|---|---|---|
| 93,556 | 8/1869 | Robinson | 5/2.1 |
| 565,496 | 8/1896 | Moore | 5/2.1 |
| 1,990,959 | 2/1935 | Saperstein | 5/2.1 |
| 4,318,195 | 3/1982 | Reppas | 5/2.1 |

FOREIGN PATENT DOCUMENTS 81770 5/1953 Norway .

*Primary Examiner*—Alexander Grosz

[57] ABSTRACT

The invention relates to a piece of furniture having a housing, which at least partially surrounds an interior space, and having at least one front side, which is mounted such that it can pivot around a horizontal pivot axis. The piece of furniture also having a lying surface which is arranged on a surface pointing towards the interior space and which can be swung out. The piece of furniture also has a further pivot axis which is arranged parallel to the first pivot axis. The piece of furniture also has a hinge connection which holds a housing upper part in a manner such that it can swing out towards the front side around the second pivot axis and which forms a writing support.

17 Claims, 3 Drawing Sheets

PIECE OF FURNITURE

BACKGROUND OF THE INVENTION

1. Field of the Invention

The invention relates to a piece of furniture, in particular for living rooms, which is equipped at least with a folding bed.

2. Discussion of Related Art

Folding beds which can be stowed in a cupboard are already known. Fold-away beds of this type have a front side which can be swung out in the direction of the base. The length of the front side essentially corresponds to the length of the lying surface. This has the result that fold-away beds of this type have a very high structure. Moreover, the handling of fold-away beds of this type is made difficult since from a certain swing-out angle the entire load of the front side and of the lying surface acts upon the person operating the cupboard. Fold-away beds of this type are preferably used in living rooms having a small living area in order thus to have sufficient space in the living area if the lying surface is not required. Fold-away beds of this type are also preferably used for guest rooms enabling an all-purpose space to be provided when the lying surface is not in use.

However, fold-away beds of this type have the disadvantage that they take up a relatively large amount of space since the front side essentially corresponds to the entire length of the lying surface. A further shortcoming is that this piece of furniture has only one function and generally is not visually attractive.

SUMMARY OF THE INVENTION

The invention is based on the object of providing a piece of furniture which combines together a number of functions, takes up a small amount of space and, moreover, has an attractive, aesthetic design.

This object is achieved by the features of claim 1.

This object is achieved by a piece of furniture including a housing that at least partially surrounds and interior space. The piece of furniture also includes at least one front side that is mounted such that the front side is pivotable about a horizontal pivot axis, a lying surface arranged directed towards the interior space and swingable outward from the interior space, a housing upper part and a hinged connection arranged on a second pivot axis parallel to the first pivot axis. The hinged connection supports the housing upper part in such a manner that the housing upper part is swingable out towards the front side about the second pivot axis and forms a writing support.

The piece of furniture according to the invention has the advantage that at least two functions for everyday requirements are combined in one housing. For one thing, the housing is provided with a folding bed and the piece of furniture can, moreover, be converted in a simple manner into a desk or bureau, a bar, a working surface, a sideboard for food or the like. The piece of furniture also, owing to his having a low height, takes up a low amount of space and, as a result, an attractive, aesthetic overall impression can also be provided. In the closed state, the external form of the piece of furniture can correspond to a chest of drawers. Use can be made of pieces of furniture of this type preferably in small living spaces, such as a room in a hall of residence, the guest room or the like.

According to an advantageous refinement of the invention, provision is made for the swing-out housing upper part to be designed as an L-shaped cover, a first leg of the L-shaped cover forming part of the front side. The front side of the piece of furniture can thereby be subdivided visually into an upper, small section and a lower, large section, thus enabling the front side to have an attractive design.

According to a further advantageous refinement of the invention, provision is made for the height of the second pivot axis around which the housing upper part can be pivoted, as seen from a surface upon which it is set up, and the length of the first leg of the L-shaped housing upper part to be coordinated with one another in such a manner that as the housing upper part is pivoted, preferably through 180° C., the second leg of the L-shaped housing upper part is arranged horizontally, at a height of between 68 and 80 cm, preferably 72 cm. This allows the housing upper part to be articulated on the housing in a variety of ways, thereby making possible different configuration options, the second leg of the L-shaped housing upper part always being able to be arranged at an ideal height as a writing support. The height of the horizontal pivot axis can thus be arranged variably on the housing of the piece of furniture, for example as a function of the length of the lying surface which is preferably of two-part design and can be folded together.

According to a further advantageous refinement of the invention, provision is made for the second pivot axis to be at least of a height above the surface upon which the housing is set up which is greater than the length of the swing-out front side with the lying surface. This makes it possible for the folding bed to be freely swung out with the housing upper part closed. Provision is advantageously made for a two-part lying surface to be fixed on the inside of the front side so that the overall height of the piece of furniture can be reduced.

According to a further advantageous refinement of the invention, provision is made, so as to reduce the overall height, for the two sections of the lying surface to be connected together via a double hinge which makes it possible for the second swing-out section to be movable, relative to the first section of the lying surface, in an essentially parallel position to the first section of the lying surface via the double hinge of the lying surface. This makes it possible for the pivot radius of the folding bed to be reduced since during the pivoting procedure, the second section can be arranged offset downwards with respect to the first section, thereby enabling the folding bed to be pivoted out over a smaller pivot radius. This makes it possible for the overall height to be further reduced, with the result that a multi-function piece of furniture can be provided which, moreover, can also be easily transported.

BRIEF DESCRIPTION OF THE DRAWINGS

The invention will now be described in detail taken together will the accompanying drawings in which.

DETAILED DESCRIPTION OF PREFERRED EMBODIMENTS

Figure 1:
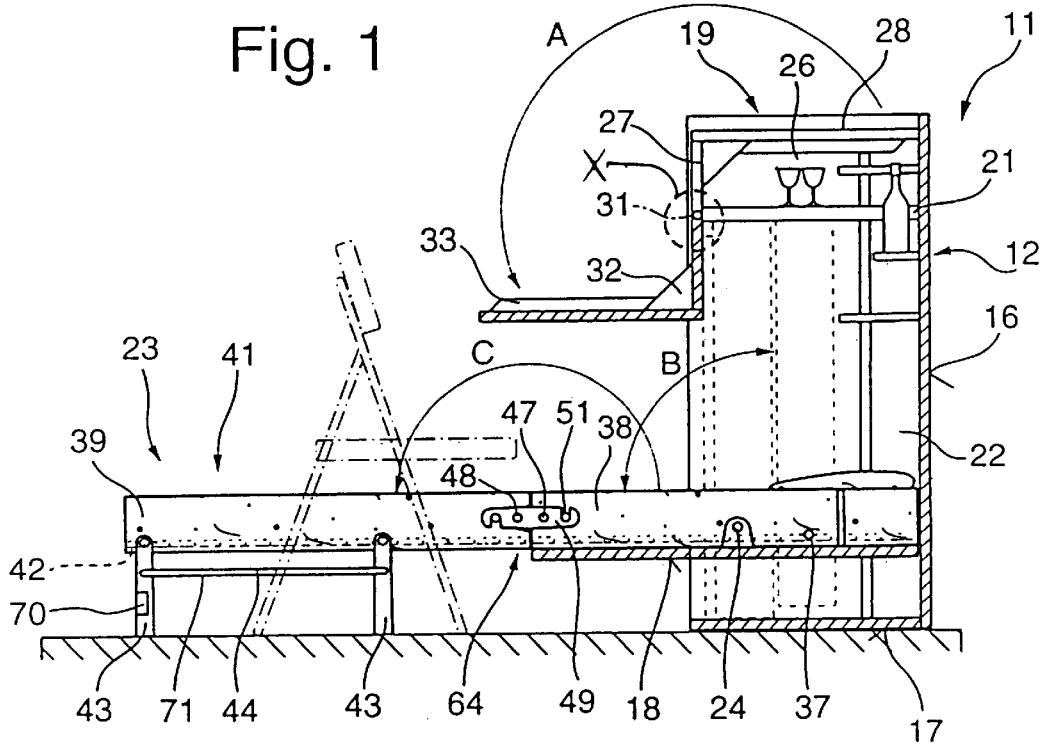
FIG. 1 shows a schematic side view of the piece of furniture according to the invention where a bed and a housing upper part have been swung out.
Figure 2:
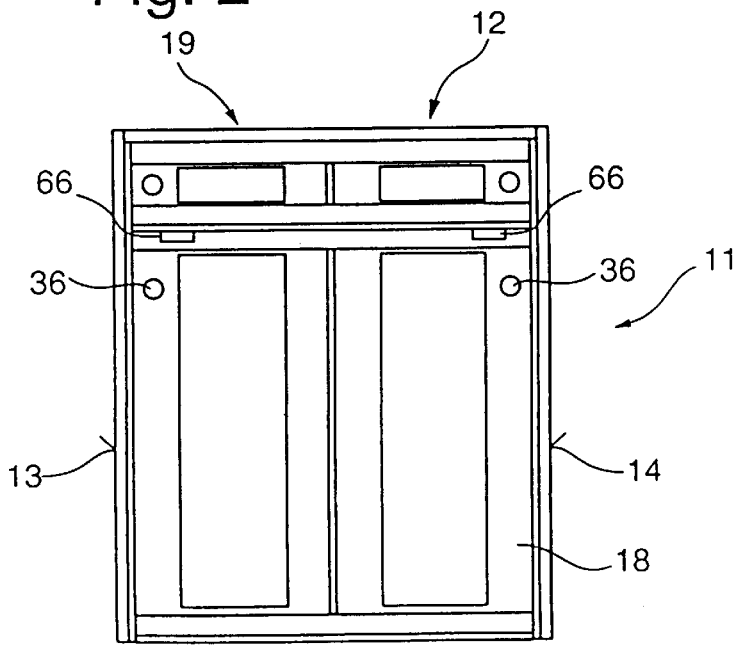
FIG. 2 shows a front view of a closed piece of furniture.
Figure 3:
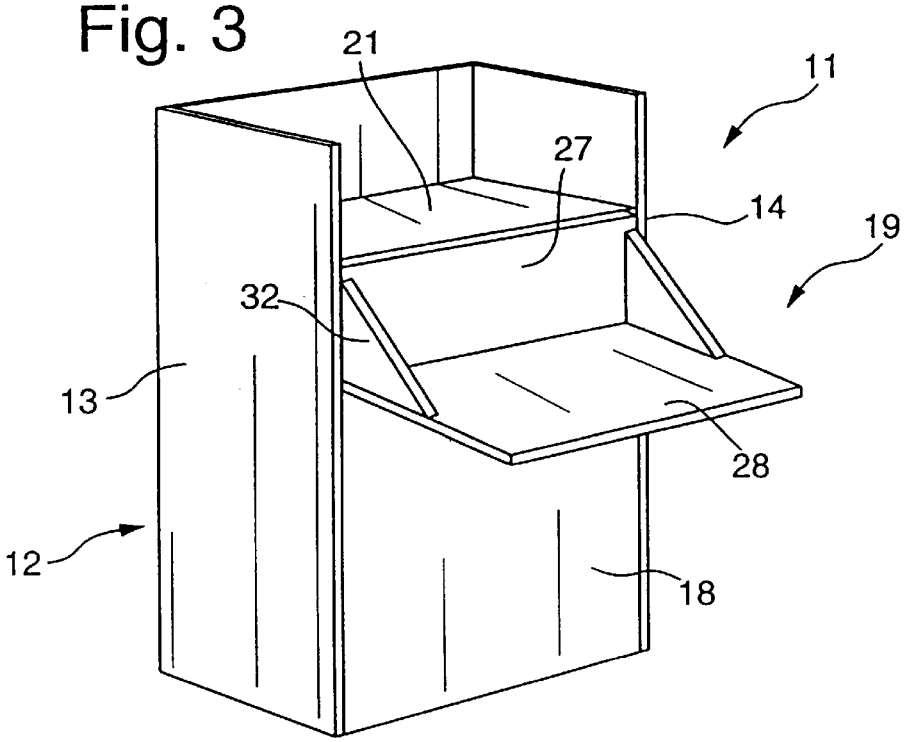
FIG. 3 shows a perspective representation of the piece of furniture as a bureau.

FIGS. 1 to 4 illustrate, in a side view, a piece of furniture 11 according to the invention as a multi-function cupboard which at least has the functions of a lying surface or a bed and of a writing support or a desk. FIG. 2 illustrates the piece of furniture 11 in a front view in the closed state. The piece of furniture 11 has a housing 12 which is composed of a left side wall 13, a right side wall 14, a rear wall 16, a base 17, a swing-out front side 18 and a housing upper part 19. In the upper region, the housing 12 has an intermediate wall 21 which closes off an interior space 22 in which a folding bed 23 is arranged. The dashed-line representation of the folding bed 23 shows a storage position in the interior space 22. Above the interior space 22 is a second interior space 26 which is bounded by the housing upper part 19. The piece of furniture 11 according to FIG. 2 is illustrated in a not-in-use state. Should a person then wish to work on a desk, this person can pivot the housing upper part 19 through approximately 180° C., in accordance with arrow A in FIG. 1, and can convert it into a bureau according to FIG. 3.

The housing upper part 19 has a first leg 27 to which a second leg 28 is joined at right angles. After the pivoting through approximately 180° C., the first leg 27 bears against an abutment in such a manner that the second leg 28 is inclined approximately horizontally or, optionally, slightly downwards in order to serve as a writing support. The abutment may, for example, be the front side 18. The front side 18 is advantageously of planar design in this region so that a bearing surface is formed. Alternatively, it is also possible for supporting elements to be provided as the abutment, which supporting elements are integrated, for example, as a design element on the front side 18. The second pivot axis 31, around which the housing upper part 19 can be swung out, is arranged with respect to the side walls 13, 14 in such a manner that it is offset forwards with respect to the front side 18 in order to make it possible for the first leg 27 of the housing upper part 19 to bear against the front side 18. Furthermore, provision may alternatively be made for the abutment to be adjusted in different ways so that depending on the configuration of the housing upper part 19, which does not absolutely have to have an L-shaped cross-section, a likewise essentially horizontal position of the second leg 28 is made possible.

The writing support formed by the second leg 28 is preferably arranged at a height of 72 cm which corresponds to a standard measurement for desk heights. Alternatively, the height of the writing support may also deviate therefrom and the writing support may be provided higher or lower. In order to arrange the second leg 28 at a height of 72 cm, as seen from the base, it is necessary for the height the second pivot axis 31 from a surface 17 on which the housing 12 is set up, and the length of the first leg 27 of the housing upper part 19 to be coordinated with one another. Further considerations are to be given to which angle the first leg 27 of the housing upper part 19 is to be positioned at in order to arrange the second leg 28 in a horizontal position.

Corner reinforcements 32 are advantageously provided between the first leg 27 and the second leg 28 in order to be able to withstand the load which occurs. Furthermore, strips 33 can be provided along the narrow side, which strips form a lateral boundary of the writing support. These strips moreover have the advantage, in particular in the case of solid-wood writing boards, that they are connected to the writing support by means of a dovetail guide. This has the advantage that the solid-wood board, the preferred direction of which is transverse to the strip 33, can have a higher rigidity. Provision may furthermore be made for a securing device to be provided in order to secure the housing upper part 19 in a swung-out state as a desk. This can be provided by a pin or latching connection or the like.

When the activities at the desk are finished, the housing upper part 19 can again be pivoted through 180° C. counter to the arrow direction A, with the result that the second interior space 26 is closed. Owing to the L-shaped design of the housing upper part 19, there may remain in the second interior space 26 a sufficiently large storage space in which, for example, it is possible for technical accessories, a computer or the like to be arranged. The housing upper part 19 can be secured in a closed position via a snap-in latching connection or the like. Provision is moreover made for the narrow sides of the housing upper part 19 to interact with the side walls 13, 14 in such a manner that a dust-proof closure 68 can be provided. This can be provided by attaching additional sealing elements or by means of an appropriate geometrical configuration of the surfaces of the housing upper part 19 and of the housing 12 which point toward each other.

The second function of the piece of furniture 11 according to the invention is provided by the folding bed 23. The folding bed is of two- or multi-part design, preferably of three-part design. The front side 18 is provided with handles 36 to swing out the folding bed 23. The front side 18 is pivoted around the first pivot axis 24, in accordance with the arrow direction a, into a horizontal position. As this happens, that end of the front side 18 which is located in the interior space 22 comes to bear against a stop 37, as a result of which a first section 38 of the lying surface is aligned horizontally with respect to a head part in the housing. Subsequently, a second section 39 of the folding bed 23 is swung open according to arrow C and through 180° C. so that a flat lying surface is formed. The first and second sections 38, 39 comprise a mattress 41 and a frame with a slatted base 42 or the like. The latter is preferably designed as a continuous slatted-based spring arrangement with wooden spring strips on a frame. Moreover, this slatted-base spring arrangement may have ventilation. Feet 43 are provided on the underside of the second section 39, which feet are connected to one another via a strut 44 so that they can be swung out or retracted together. This retractable stand is arranged on the lying surface and has four legs (43) and a transverse connection (70) and articulated rods (71) for guiding the legs in parallel and retracting the legs from one side.

The first and second sections 38, 39 of the folding bed 23 are connected to one another via a double hinge 64. The double hinge 64 is designed as a flange which has a first rotational axis 47 on the first section 38 and a second rotational axis 48 on the second section 39 of the folding bed 23. A U-shaped recess 49 is furthermore provided on the right-hand end of the flange and to the right of the first rotational axis 47, into which recess a bolt 51 engages, thereby limiting the pivoting movement of the second section 39 with respect to the first section 38 of the folding bed 23. The rotational axes 47, 48 of the double hinge 64 are spaced apart from one another in such a manner that those edges of the first and second sections 38, 39 which point towards one another do not block each other in the event of a pivoting movement in and counter to arrow direction C.

Figure 4:
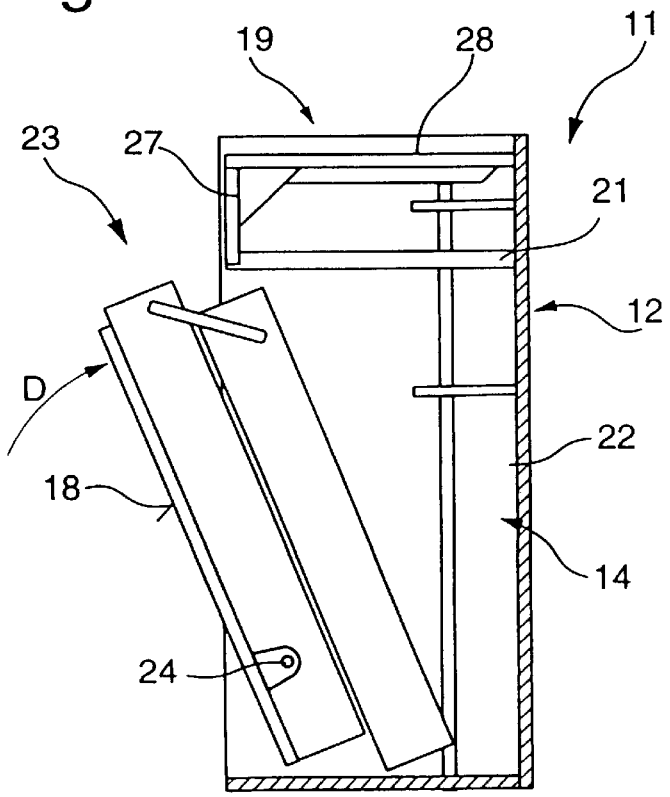
FIG. 4 shows a schematic side view of the piece of furniture as the folding bed is being swung out.

Furthermore, the double hinge 64 has the advantage that the second section 39 can be displaced in parallel to the first section 38, as is shown in FIG. 4. As a result, the pivot radius can be of smaller design, thereby enabling the height of the piece of furniture 11 to be kept to a minimum. As the front side 18 is being pivoted in according to the arrow direction D in FIG. 4, for example, the lower end of the second section 39 lies on the base 17. As a result, there is sufficient space in the upper region near to the second pivot axis 31 of the housing upper part 19 for the first and second sections 38, 39 of the folding bed 23 to be able to be pivoted in. In an end phase the first and second sections 38, 39 of the folding bed lie in a position as is shown by dashed lines. Owing to the two-part mattress 41, it is possible for the height of the housing 12 to be of very small construction and to have, for example, the dimensions of 115 cm height and 90 cm width and 50 cm depth. This piece of furniture 11 can thus preferably be set up as a bureau or bar which forms an additional sleeping option.

Bedding may furthermore be stowed in the interior space 22 of the piece of furniture 11. In addition, a shelf and a lamp, for example, may be included therein. The rear wall 16 of the housing 12 has a perforated grid arrangement so that a certain degree of ventilation is provided. Moreover, the front side 18 has, for example, two or three parts, with the result that air gaps arise in order to produce air circulation in the interior space 22. This air circulation prevents the dampness produced by a human body and absorbed by the mattress from starting to go mouldy. Hygiene in bed can substantially be improved thereby.

The front side 18 is mounted such that it can pivot via a known hinge connection to the side walls 13, 14 or to a frame (not shown). This frame can be attached to the side wall 13, 14 or can be self-supporting.

Figure 5:
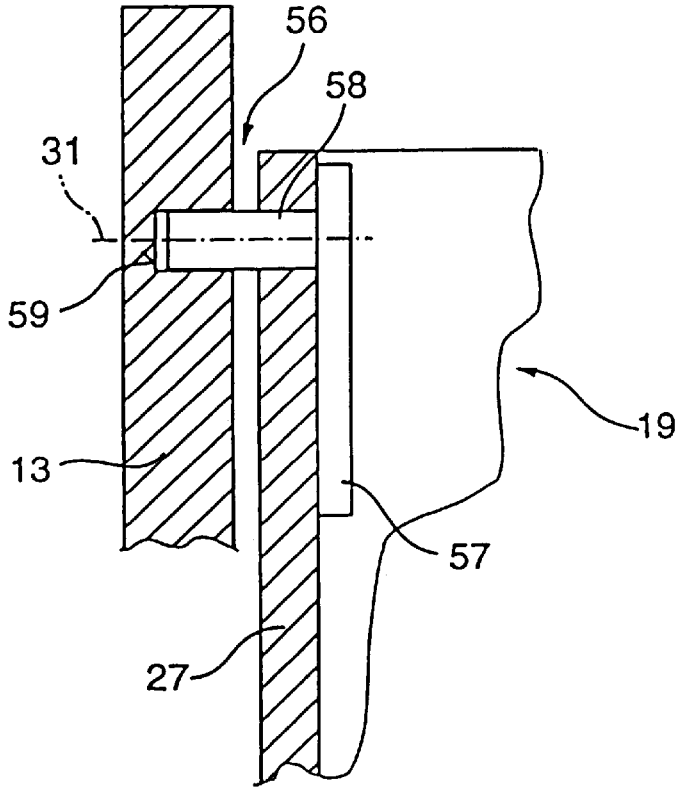
FIG. 5 shows a detail view of a hinge connection for a housing upper part.
Figure 6:
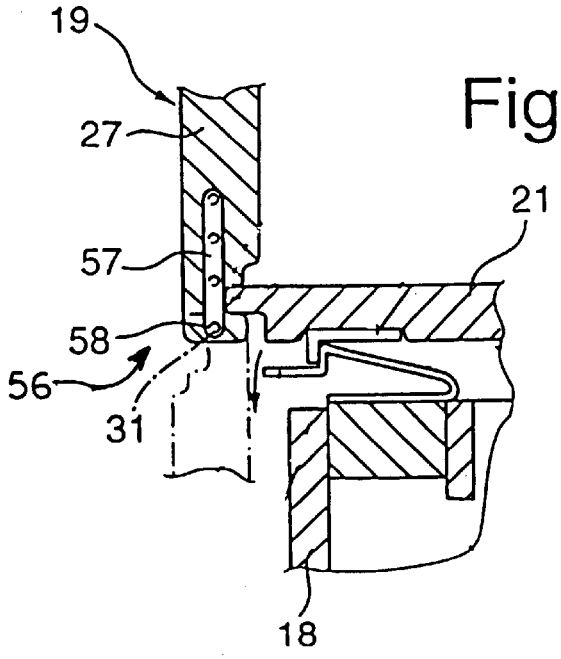
FIG. 6 shows an enlarged representation of a detail X in FIG. 1.

FIGS. 5 and 6 show an example of a hinge connection 56 which is situated in the second pivot axis 31 and is intended to pivot the housing upper part 19. This hinge connection 56 is designed as a pin plate which acts on and is screwed to a plate 57 on the first leg 27 of the housing upper part 19. The plate 57 is furthermore provided with a pin 58 which engages into a hole 59 in the side walls 13, 14 and is mounted rotatable. This hinge connection 56 makes possible a space-saving arrangement which is cost-effective in assembly. Further alternative hinge connections for the design of a second pivot axis 31 can also be provided.

I claim:

1. A piece of furniture comprising:

a housing (12) that at least partially surrounds an upper and a lower interior space (26, 22), at least one front side (18) that is mounted such that said front side (18) is pivotable about a horizontal first pivot axis (24), a lying surface (23) arranged directed towards said lower interior space (22) and swingable outward from said lower interior space (22), a housing upper part (19), and a hinged connection (56) arranged on a second pivot axis (31) parallel to said first pivot axis (24), which hinged connection (56) supports said housing upper part (19) in such a manner that said housing upper part (19) is swingable out towards said front side (18) about said second pivot axis (31) and forms a writing support, wherein said housing upper part (19) is of an L-shaped form and has a first leg (27) forming a portion of said front side (18) and a second leg (28) extending nearly along the total depth of said housing (12) and forming an upper side that covers at least a portion of said upper and lower interior space (26, 22), said L-shaped housing upper part (19) is swingable into an open position in which said L-shaped housing upper part (19) bears against an abutment, and said housing (12) has an intermediate wall with a least one opening to said lower interior space (22).

2. The piece of furniture according to claim 1, in which said second pivot axis (31) is arranged offset downwards with respect to an upper edge of said housing (12) and said L-shaped housing upper part (19) is pivotable through approximately 180°.

3. The piece of furniture according to claim 1, in which said L-shaped housing upper part (19) is swingable into said open position with respect to said upper interior space (26), with said lying surface (23) swung out or with said front side (18) in a closed position.

4. The piece of furniture according to claim 1, in which said housing (12) includes a base (17) and the height of said second pivot axis (31), as seen from said base (17) and the length of said first leg (27) of said housing upper part (19) are coordinated with each other in such a manner that said second leg (28) of said housing upper part (19) when swung into an open position is arranged at a height between approximately 65 cm and 88 cm.

5. The piece of furniture according to claim 4, in which said housing upper part (19) when swung into an open position is arranged at a height of about 72 cm.

6. The piece of furniture according to claim 1, in which said second leg (28) is arranged substantially horizontal when said housing upper part (19) is swung into an open position.

7. The piece of furniture according to claim 1, in which said housing (12) includes a base (17), and said second pivot axis (31) is at least a height above said base (17) that is greater than the length of said swing-out front side (18).

8. The piece of furniture according to claim 1, in which said housing (12) includes side walls (13, 14), and said hinge connection (56) comprises a pin plate (57) that engages into a hole (59) in said side walls (13, 14) by means of a pin (58) and is connected on a side surface of said housing upper part (19).

9. The piece of furniture according to claim 1, in which said housing (12) includes side walls (13, 14), in which a dust seal is formed on portions of said side walls that are adjacent to side surfaces of said housing part (19).

10. The piece of furniture according to claim 1, in which said housing (12) also includes side surfaces (13, 14), and said first pivot axis (24) is arranged on a lateral strut that intersects with said side surfaces (13, 14).

11. The piece of furniture according to claim 1, in which said lying surface (23) comprises a multi-part lying surface (41) that is swingable outward from said interior space (22).

12. The piece of furniture according to claim 11, comprising a double hinge (64) that couples together a first and a second part (38, 39) of said lying surface (23).

13. The piece of furniture according to claim 12, in which said double hinge (64) has a flange having a first rotational axis (47) on said first part (38) and a second rotational axis (48) on said second part (39) and a U-shaped recess (49) facing said first part (38) and into which a bolt (51) engages as a stop in a swung-open position of said first and second parts (38, 39).

14. The piece of furniture according to claim 12, in which said second part (39) is movable into a substantially parallel position relative to said first part (38) via said double hinge (64).

15. The piece of furniture according to claim 1, in which said intermediate wall (21) separates said upper interior space (22) from said lower interior space (26).

16. The piece of furniture according to claim 1, further comprising a retractable stand arranged on said lying surface having at least four legs and a transverse connection (70) and articulated rods (71) for guiding said legs in parallel and retracting said legs from one side.

17. A piece of furniture comprising:

a housing (12) that at least partially surrounds an interior space (22, 26), at least one front side (18) that is mounted such that said front side (18) is pivotable about a horizontal first pivot axis (24), a lying surface (23) arranged directed towards said interior space (22) and swingable outward from said interior space (22), a housing upper part (19), and a hinged connection (56) arranged on a second pivot axis (31) parallel to said first pivot axis (24), which hinged connection (56) supports said housing upper part (19) in such a manner that said housing upper part (19) is swingable out towards said front side (18) about said second pivot axis (31) and forms a writing support, wherein said lying surface (23) comprises a multi-part lying surface (41) that is swingable outward from said interior space (22), further comprising a double hinge (64) that couples together a first and a second part (38, 39) of said lying surface (23), wherein said double hinge (64) has a flange having a first rotational axis (47) on said first part (38), a second rotational axis (48) on said second part (39) and a U-shaped recess (49) facing said first part (38) and into which a bolt (51) engages as a stop in a swung-open position of said first and second parts (38, 39).

* * * * *